United States Patent [19]

Lloyd

[11] 4,266,163

[45] May 5, 1981

[54] INCIDENT METERING ELECTRONIC FLASH CONTROL

[75] Inventor: Havelock D. Lloyd, Los Angeles, Calif.

[73] Assignee: Vivitar Corporation, Santa Monica, Calif.

[21] Appl. No.: 55,539

[22] Filed: Jul. 9, 1979

[51] Int. Cl.[3] ..... H05B 41/32

[52] U.S. Cl. ..... 315/151; 250/214 P; 354/33; 354/128

[58] Field of Search ..... 315/151, 159, 241 P; 354/33, 60 F, 145, 149, 128; 250/214 P

[56] References Cited

U.S. PATENT DOCUMENTS

| | | | |
|---|---|---|---|
| 3,823,410 | 7/1974 | Tokutomi et al. | 354/33 |
| 3,836,924 | 9/1974 | Kawasaki | 315/151 X |
| 3,842,428 | 10/1974 | Kawasaki | 354/145 |
| 3,868,701 | 2/1975 | Kawasaki | 354/149 X |

*Primary Examiner*—Eugene La Roche
*Attorney, Agent, or Firm*—Lyon & Lyon

[57] ABSTRACT

There is disclosed herein an electronic system and method for metering the incident light on a subject being photographed, some or all of which light emanates from an electronic flash unit, and for storing an incident light value for use in controlling the electronic flash unit during the taking of subsequent photographs of the subject. An exemplary system includes a remote light sensor which can be placed at or near the subject being photographed for measuring the light incident on the subject during a "test flash" from the electronic flash unit so as to enable the storage of an incident light value. This incident light value may comprise a signal representing the duration of the flash or a signal proportional to the drop in energy of the supply source of the electronic flash unit, both of which are proportional to the quantity of incident light. When a subsequent flash of light is emitted by the electronic flash unit for taking a photograph, an electrical signal, which may represent the energy source change, is monitored and compared with the stored value in order to derive a quench or termination signal for terminating the flash of light from the electronic flash unit.

15 Claims, 1 Drawing Figure

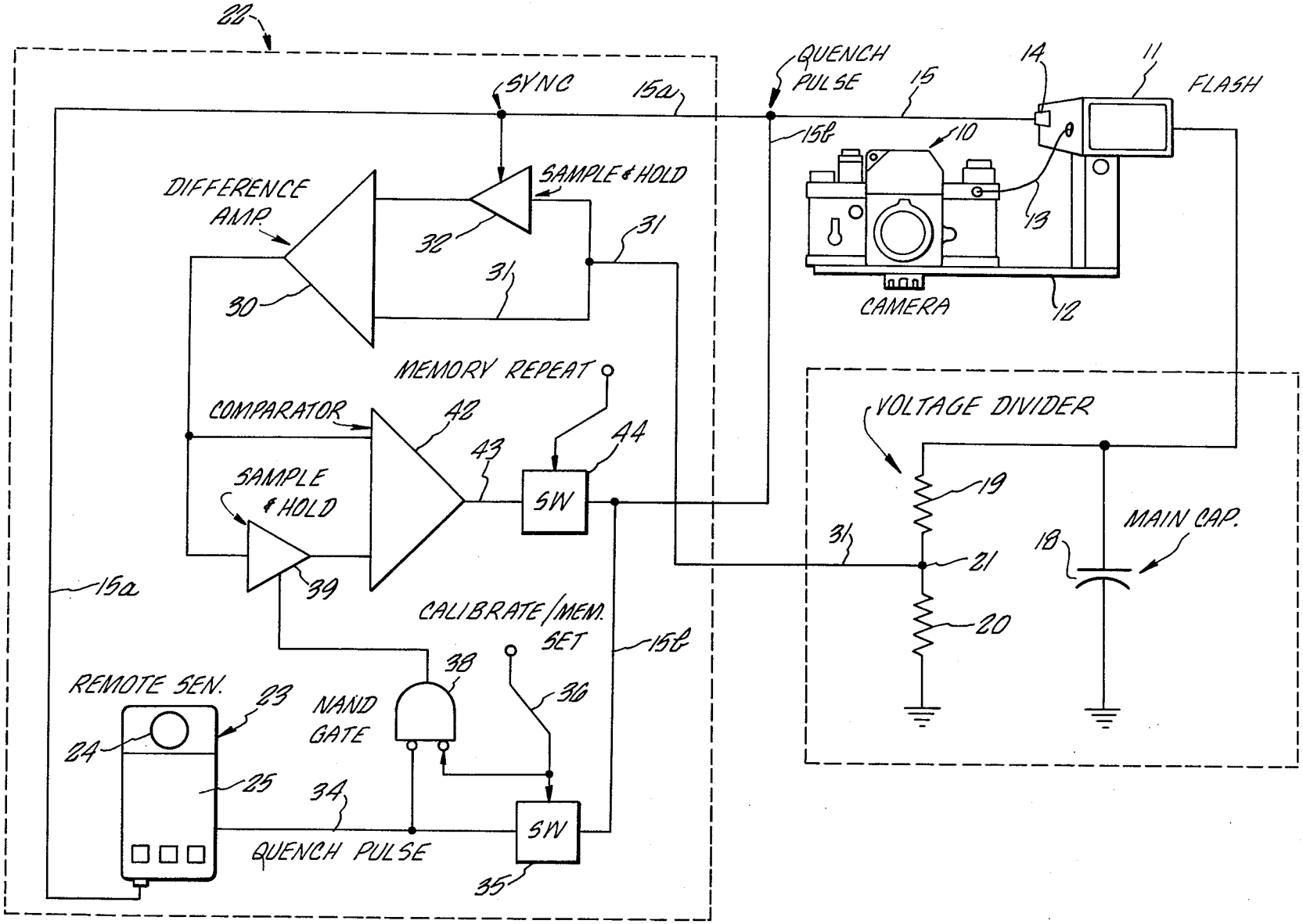
FLASH
11
14
13
12
10
15
CAMERA
QUENCH PULSE
15b
VOLTAGE DIVIDER
MAIN CAP.
18
19
21
20
31
15a
SYNC
SAMPLE & HOLD
32
31
MEMORY REPEAT
44
S/N
15b
CALIBRATE/MEM. SET
36
S/N
35
43
42
38
NAND GATE
34
QUENCH PULSE
DIFFERENCE AMP.
30
COMPARATOR
SAMPLE & HOLD
39
23
25
REMOTE SEN.
24
15a
28

INCIDENT METERING ELECTRONIC FLASH CONTROL

BACKGROUND OF THE INVENTION

1. Discussion of Prior Art

Various types of automatic electronic flash units have been developed, and basically these units include a flashtube, an electronic power source for the flashtube, a light sensor circuit to measure light from the flashtube which is reflected from the subject being photographed, and a quench circuit activated by the light sensor circuit to turn off the flash after sufficient light has been received at the subject. The sensor circuit includes a light sensor which usually is mounted in the housing of the flash unit, but sometimes is physically detachable and remotely positionable while being connected to the flash unit by a suitable electrical cord. Various such flash units are commercially available, a typical such unit being the Model 283 Electronic Flash Unit sold by Vivitar Corporation.

While such automatic electronic flash units have met with wide acceptance and are used by many professional and amateur photographers, the nature of the light sensor arrangement at or near the flash unit itself for measuring reflected light, rather than measuring light incident on the subject being photographed, results in inaccuracies in precisely controlling the amount of light incident on the subject. Typical flash units of this nature include a sensor which has a finite light sensing angle and are designed to view the subject as being "18% grey." However, if the subject is darker or lighter, or the primary subject is not in the metering center of the scene, the sensor of the flash unit will make an erroneous reading based upon the information supplied in the form of the design of the sensor and sensor system. The sensor of the automatic flash unit depends on the reflectivity of the scene within a defined area specified by the angular view of the light sensor and, thus, close proximity of dominant reflective surfaces also can greatly affect picture quality.

Conventional light meters which measure reflected light also suffer from similar deficiencies. Thus, reflected meter readings are subject to the same deficiencies as are the reflected light readings made by the light sensor of an automatic electronic flash unit. Light meters for measuring "incident" light have been used for years to enable more accurate meter readings under conditions where the subject varies from an average. These incident light meters are positioned near the subject to read the quantity of light impinging thereon, while ignoring the reflectivity of the subject. Even if the reflectivity of the subject changes, if the quantity of light thereon is constant the subject remains correctly illuminated and the incident light meter will so indicate. However, the response characteristics of continuous light measuring types of incident light meters are not sufficient to measure an electronic flash which has a typical duration of less than one to two milliseconds.

Developments have been made in the electronic flash field in an attempt to accomplish more accurate metering by measuring incident light. Such incident light measuring devices provide information by which the user can set his camera aperture for correct flash exposure. Although an incident flash meter can measure a sample output of a flash unit at a given place in the scene and provide good results, there is no assurance that the output of the next flash will be identical. This problem could be solved by placing the light sensor via a remote cable at the subject for metering the incident light during the picture flash exposure; however, the incident light sensor, its support and cable would appear in the photograph and this is undesirable. While this could be overcome by camouflaging or disguising the sensor and/or using a wireless control system back to the flash unit, either approach is bothersome, cumbersome and expensive.

Another attempt which has been made to obviate the foregoing problems is by using a light sensor or sensors which meter the light at the film plane of a camera, such as illustrated in U.S. Pat. No. 3,840,882, U.S. Pat. No. 3,779,141 and U.S. Pat. No. 3,726,197. Such arrangements generally require a special type or "dedicated" electronic flash unit for use with the camera, and also suffer from other metering difficulties such as sensor angle, reflectivity and so forth.

In addition to the foregoing and while not related to the aforementioned problems but related to camera operating characteristics, systems have been proposed for generating a preparatory flash, storing an electrical signal which is a function of the received light reflected from the subject, and then firing a flash or taking the photograph and using the stored signal for quenching the flash. Such a system is shown and described in U.S. Pat. No. 3,842,428, and variations thereof are shown and described in U.S. Pat. No. 3,836,924 and U.S. Pat. No. 3,868,701. In these systems, the flash of light received by and reflected from the subject is metered by a light sensor disposed in a camera, rather than the incident light on the scene being metered, and the reflected light value is stored for the purpose of retaining this light value as the camera light sensors are moved or otherwise unavailable for metering during the actual taking of the photograph. Such systems are relatively complicated, require a preparatory flash and a main flash each time a photograph is taken and, significantly, suffer from many of the usual drawbacks of metering light reflected from the subject as distinguished from metering incident light on the subject.

2. Field of the Invention

The prevent invention relates to the field of electronic flash photography, and more particularly relates to an electronic incident flash memory system for enabling the incident light from an electronic flash unit to be more accurately controlled as well as to be preprogrammed.

3. Related Application

The subject matter of the present application relates to the subject matter of U.S. Application Ser. No. 55,538 filed concurrently herewith in the name of Ralph J. Gagnon and assigned to the assignee of the present application, and which discloses additional electronic circuits and systems useful in implementing the concepts of the present invention, the disclosure of which is incorporated herein by reference.

SUMMARY OF THE INVENTION

The present invention overcomes the deficiencies of the prior art by providing a remote incident light sensor, similar to the light sensor of the automatic electronic flash unit, at the scene to be photographed, test firing the flash unit, terminating the flash via the remote sensor when sufficient light has been received at the scene, and storing an electrical signal which is a function of the incident flash light quantity, namely, an incident light value. In this manner, the scene is properly and completely test illuminated as a function of desired camera shutter speed, aperture and film speed chosen by the photographer. Then, the remote incident light sensor is removed from the scene and the photograph is taken with the camera and electronic flash unit in the usual manner; however, the light from the electronic flash unit is terminated, not as a function of the light now received at or reflected from the scene, but as a function of the previously stored incident light value. The stored light value may be a signal proportional to flash duration and/or a signal which is a function of the change of energy of the main supply source of the electronic flash unit.

In a preferred embodiment of the concepts of the present invention, the initial or starting voltage of the main capacitor of the electronic flash unit is sampled and stored. Then, upon the completion of the initial test flash, the main capacitor voltage is sensed and the voltage drop or voltage difference is stored. When the flash is again fired for taking a photograph, the initial voltage of the main capacitor (which may vary from flash to flash) is again sensed and compared with the stored voltage difference, and when these are approximately equal a quench signal is supplied to the electronic flash unit to terminate the flash of light. Thus, a light sensor is used to make an incident flash light measurement, an incident light value signal is stored, and this signal is used to terminate the next flash in an electronic manner rather than in the usual optical/electronic manner using the reflected light sensor of a flash unit. As many photographs as desired may be taken of the scene (and, if desired, with changes by the photographer in camera parameters for special effects) since the stored light value remains memorized, and differences in the initial or starting voltage of the main capacitor are automatically compensated.

An incident flash memory circuit according to the present invention can be provided as an accessory for an automatic electronic flash unit which already contains much of the required circuitry, such as the Vivitar Model 283, and, thus, a flash control module according to the present invention can be relatively compact and inexpensive. By measuring a desired quantity of light and storing a signal proportional thereto, the subsequent flashes can be automatically quenched in a simple manner to provide accurate exposures. Such a flash control provides distinct advantages over conventional flash meters, such as substantially reduced costs and the ability to preselect a desired camera aperture by preprogramming. Instead of measuring the incident light with a conventional incident flash meter, varying flash-to-subject distances, experimenting with various aperture settings, and the like, the automatic electronic flash unit can be positioned where desired, the sensor sensitivity set in a conventional manner (by selecting the appropriate ASA setting and preprogramming the desired aperture), fire the flash unit and set the flash quantity in memory, and then take the desired photograph or photographs. The flash control module may communicate with the flash unit by a cable or by use of a wireless remote sensor system.

Accordingly, it is an object of this invention to provide an improved electronic flash system.

Another object of this invention is to provide a new incident metering electronic flash control system.

An additional object of this invention is to provide the photograher with the ability to preprogram the incident level of light arriving at a subject being photographed.

A further object of this invention is to provide an improved method of flash photography.

These and other objects and features of the present invention will become better understood through a consideration of the following description taken in conjunction with the drawing which illustrates an exemplary embodiment of the present invention.

DETAILED DESCRIPTION

Turning now to the drawing, a conventional single lens reflex camera 10 is shown wth an automatic electronic flash unit 11 attached thereto by a bracket 12. An electrical sync cable 13 is connected from the camera 10 to the flash unit 11 to provide a sync signal to the flash unit when the shutter release button of the camera 10 is depressed. As is known, conventional automatic electronic flash units like 11 include a trigger circuit responsive to this sync signal for firing the flashtube of the flash unit such that the flashtube emits a flash of light. Such flash units 11 further include a quench circuit for terminating the flash of light after sufficient light has been received at the subject. Usually, the quench circuit is controlled by a light sensor disposed in or on the housing of the flash unit, but sometimes is remotely connected thereto by a cable, which sensor is responsive to light reflected from the subject. The flash unit 11 includes a plug 14 connected with a cable 15 for supplying as an output the sync signal initiated by the camera (or by a push button on the flash unit) and for receiving as an input a quench pulse to trigger the quench circuit of the flash unit.

Additionally, the flash unit 11 includes a power supply, usually built in, which comprises generally a battery pack and circuit for charging the main capacitor of the flash unit. The main capacitor provides the source of current for the flashtube when the same is triggered. In the illustration of the drawing, the main capacitor 18 has been shown outside of the housing of the flash unit 11 for illustrative purposes; however, this capacitor is conventionally included within the flash unit. Additionally, a voltage divider comprising resistors 19 and 20 connected across the main capacitor 18 are shown, and these normally were contained within the housing of the flash unit 11. Typically, the main capacitor 18 when fully charged has a voltage thereon of approximately 400 volts. The voltage divider 19–20 provides a proportional reduced voltage at an output terminal 21 for use in the present incident metering flash control system indicated generally within dashed line box 22 and which will be explained in greater detail below.

The flash control system 22 includes a remote sensor 23 comprising a light sensor 24 and conventional light sensor circuit (not shown) contained within a housing 25. The purpose of the remote sensor 23 is to sense incident light reaching the subject or scene to be photographed upon command of the sync signal from the camera 10, or a similar signal from the flash unit 11, and to provide a quench pulse back to the flash unit 11 for terminating the flash of light therefrom. For this purpose, the remote sensor 23 is physically positioned at or near the subject or scene to be photographed and the cable 15 provides these signals to and from the flash unit, one cable **15*a* being illustrated for supplying the sync signal to the remote sensor 23 and another cable 15*b* being shown for supplying the quench pulse back to the flash unit 11, although it will be understood to those skilled in the art that typically a single cable would be provided. The remainder of the circuit shown within the dashed line block 22 serves to sense the voltage of the main capacitor 18, store a differential voltage proportional to the amount of light reaching the subject upon the initial or test firing of the flash unit, providing a quench pulse to the flash unit upon completion of the initial or test firing, and for providing a quench pulse to the flash unit 11 upon each subsequent firing of the flash unit 11 in taking photographs of the scene. Typically, all of the components within the dashed line block 22 are contained within a relatively compact and portable remote sensor unit which can be easily carried to and from the subject being photographed and/or mounted on a tripod or other support. Additionally, this flash control unit may receive and send the sync signal and quench pulse in a wireless manner by employing appropriate transmitters and receivers, thereby obviating the need for the cable 15**.

Turning now to a more detailed discussion of the components and operation of the flash control system 22, the same includes a difference amplifier 30 for developing a difference voltage proportional to the quantity of light measured by the remote sensor 23. A line 31 (which may be part of cable 15) supplies a voltage proportional to the initial or starting voltage of the main capacitor 18 directly to the lower input of the difference amplifier 30 and to a sample and hold circuit 32 which is connected to the upper input of the difference amplifier 30. The sync signal from cable 15*a* is connected to "enable" the sample and hold circuit 32 to both sample and store the voltage on the line 31. The sync signal typically is provided upon depression of the shutter release button of the camera 11, but also can be provided by the "open" flash button typically found on the flash unit 11, or by a similar button on the remote sensor 23 or in the control circuit 22. The sync signal typically is a short duration signal and enables the sample and hold circuit 32 to store the initial or starting voltage of the main capacitor 18 when the sync signal occurs.

Assuming now that the sync signal has occurred and the sample and hold circuit 32 has stored the initial voltage of the main capacitor 18, and the sync signal has triggered the flash unit 11 in the usual manner, the voltage on the main capacitor 18 decreases as the same discharges into the flashtube of the flash unit 11. The difference amplifier 30 continually measures the difference between the initial voltage held by circuit 32 and the decreasing voltage supplied by line 31. After a sufficient quantity of light has been received at the subject as determined by the sensitivity setting of the remote sensor 23, the remote sensor 23 provides an output quench pulse on a line 34 to a switch 35. This switch 35 is in the calibrate or test mode and is "on". Thus, the quench pulse passes through the switch 35 and the cable 15*b* to the flash unit 11 to quench the flash of light.

Turning again to the initial operation, the switch 35 is enabled by a suitable signal on a line 36 in the calibrate mode, and the switch 35 thus is on during the calibrate mode, but is turned off during a subsequent memory set mode wherein the incident light value is retained. Additionally, the signal on the line 36 in the calibrate mode enables a nand gate 38 to condition a second sample and hold circuit 39 to continually sample the difference voltage from the difference amplifier 30 as the voltage of the main capacitor 18 decreases during the test flash. When the quench pulse is received on line 34 indicating that sufficient light has been received by the remote sensor 23, the nand gate 38 causes the sample and hold circuit 39 to switch to the hold mode, thereby retaining the difference voltage which exists at the time of quench. This voltage is proportional to the desired quantity of light measured by the remote sensor 23 and can be referred to as the incident light value. The operation described thus far completes the test flash and storage of the incident light value, and the remote sensor 23 can be removed from the scene.

Photographs now can be taken with the camera 10 and flash unit 11, and the flash light will be quenched whenever the voltage of the main capacitor 18 drops by the same or approximately the same voltage as when the test flash was made inasmuch as a voltage proportional thereto is now stored in the sample and hold circuit 39. In the main flash or photograph mode, the difference amplifier 30 and sample and hold circuit 32 function in the same manner as described above. That is, the sample and hold circuit 32 stores the starting voltage of the main capacitor 18 (which may or may not be the same as the earlier starting voltage) when the sync pulse occurs initiating the flash from the flash unit, and as the voltage of the main capacitor 18 decreases, the difference amplifier 30 provides a difference voltage output which is the difference between the new starting voltage and a voltage proportional to the instantaneous voltage of the main capacitor 18 as the same discharges into the flashtube. When the difference voltage from the difference amplifier 30 is the same or approximately the same as the voltage stored in the sample and hold circuit 39, a comparator 42 provides a quench signal on a line 43. In this photograph mode, or memory repeat mode, the switch 35 is off and a switch 44 is "on," and the quench signal on the line 43 is supplied through the switch 44 and cable 15*b* to the flash unit 11 to quench the flash of light. The switch 35 is off at this time because it is in a memory set mode wherein the stored voltage is held by the circuit 39.

In summary, a signal proportional to the quantity of incident light received at the scene in the test firing of the flash unit 11 is stored by the sample and hold circuit 39 during the electro/optical incident light measurement made in the test or calibrate mode by the remote sensor 23. Then, when taking subsequent flash photographs, the starting voltage of the main capacitor 18 is again measured and when the drop in voltage of the main capacitor is the same or approximately the same as upon completion of the test firing, the quench pulse is applied to the flash unit 11 from the capacitor 42. In this manner, an incident light quantity can be simply stored over a short or long period, the light sensor system can be removed from the scene, and subsequent flash photographs be made automatically with electronic quench and with compensation for variations in the starting voltage of the main capacitor 18, which variations can occur, as for example, from the voltage on the main capacitor 18 varying from flash to flash as a result of the same being completely or incompletely recharged. Thus, the quantity of light output for each flash as controlled by the memorized value will be constant from flash to flash even if the flash unit has not completely recycled (the main capacitor completely recharged) since the system automatically compensates for lower or higher main capacitor voltages, both during the test flash and the main flash. Additionally, variations in the amount of light can be preprogrammed into the system in various ways, such as by adjusting the sensitivity of the remote sensor by the usual aperture disc or electrical resistance variation used with the light sensor systems of conventional automatic flash units.

While exemplary embodiments of the present invention have been described and illustrated, it will be apparent to those skilled in the art that variations and modifications may be made therein which come within the spirit and scope of the appended claims.

What is claimed is:

1. An electronic flash control system for enabling incident light measurements to be made at a scene to be photographed and a signal to be stored which is proportional to the desired quantity of light received at the scene for automatically controlling quench of an electronic flash unit when taking a subsequent flash picture comprising, remote sensor means for measuring incident light at a scene, said remote sensor means comprising a light sensor circuit responsive to a control signal for measuring the incident light and providing a quench signal for causing termination of a flash of light from an electronic flash unit, first circuit means for receiving a signal proportional to the energy used in firing a flashtube of a flash unit, said first circuit means including storage means for storing the initial value of said energy and providing as an output a difference signal comprising an incident light value which is a function of the energy used in production of a flash and proportional to the quantity of light incident on the remote sensor means, second circuit means responsive to the quench signal from said remote sensor means for storing said incident light value, and said first and second circuit means being adapted to respond to the initiation of a subsequent flash of light from a flash unit for again measuring the then existing initial value of said energy and providing another quench signal when a new difference signal generated by said first circuit means bears a predetermined relationship to said incident light value.

2. A system as in claim 1 wherein, the flash unit comprises an energy source in the form of a capacitor, and said first circuit means stores a voltage proportional to the starting voltage of the capacitor and provides as an output a signal proportional to the drop in voltage of the capacitor between initiation and termination of the flash of light from the flash unit.

3. A system as in claim 1 wherein, said storage means of said first circuit means is enabled to store said initial value of energy upon the occurrence of a sync pulse which fires the electronic flash unit.

4. An electronic flash control system for measuring incident light at a scene and for controlling the flash light duration of an automatic electronic flash unit employing a capacitor for energizing a flashtube of the flash unit comprising, remote sensor means for measuring incident light at a scene, said remote sensor means comprising a light sensor circuit responsive to a control signal which initiates a flash of light from a flash unit for measuring the incident light and providing a quench signal for causing termination of the flash of light, first circuit means responsive to the control signal and the voltage of the main capacitor for storing a voltage which is function of the energy used from the capacitor between initiation and termination of the flash of light, second circuit means responsive to the quench signal from said remote sensor means for storing said voltage as an incident light value, and said first and second circuit means being interconnected to respond to the initiation of a subsequent flash of light for measuring the voltage which is a function of the energy used between initiation and termination of the second flash of light and providing another quench signal when this voltage bears a predetermined relationship to said incident light value.

5. An electronic flash control system as in claim 4 wherein, said first circuit means includes difference amplifier means and storage means, and said difference amplifier means is responsive to the storage means and the voltage of the capacitor for developing the incident light value, and said second circuit means includes gating means responsive to the quench signal from said remote sensor means for causing said incident light value to be stored in storage means of said second circuit means, and said second circuit means includes comparator means for providing a subsequent quench signal when difference voltage of the capacitor becomes approximately the same voltage as the incident light value.

6. An electronic flash control system as in claim 5 wherein, said second circuit means includes switch means for controlling the gating means thereof in sensing the difference voltage and storage of the incident light value, and said second circuit means includes second switching means for allowing the subsequent quench signal to pass from said comparator means to terminate the flash of light.

7. An electronic flash control system for metering incident light in response to a sync signal which initiates operation of an automatic electronic flash unit and for controlling termination of the flash of light from the flash unit, and whereby the electronic flash unit includes as an output a voltage proportional to the flashtube source and includes an input for receiving a quench pulse for terminating a flash of light therefrom, comprising, first memory means responsive to the sync signal for storing the initial value of the supply source, difference means responsive to said memory means and the supply source for monitoring the decrease in voltage thereof as a flash of light is emitted from the flashtube, incident light sensing means responsive to the sync signal for sensing light received at a scene illuminated by the flash of light and for providing a quench pulse for said flash unit when a predetermined quantity of light has been received thereby, second memory means responsive to the difference means and the quench pulse from the sensing means for storing the energy difference occurring between the sync signal and the quench pulse, and comparator means for providing an output quench pulse for the flash unit when the energy difference after another sync signal as a result of a subsequent flash of light from the flash unit approximates the value stored in the second memory means.

8. An electronic flash control system for enabling incident light measurements to be made at a scene to be photographed and a signal to be stored which is proportional to the desired quantity of light received at the scene for automatically controlling quench of an electronic flash unit when taking a subsequent flash picture comprising, remote sensor means positionable at the scene for measuring incident light at a scene, said remote sensor means comprising a light sensor circuit responsive to a sync signal which initiates the flash of light from an automatic flash unit and for measuring the incident light and providing a quench signal for causing termination of the flash of light from the flash unit, and said remote sensor means including means for adjusting the sensitivity thereof to incident light received thereby for allowing a desired quantity of light to be preprogrammed for the system, circuit means responsive to the sync signal for storing an incident light value which is a function of the desired quantity of incident light received at the scene between occurrence of the sync signal and the quench signal, and said circuit means responding to the initiation of a subsequent flash of light from the flash unit in response to a subsequent sync signal for comparing an electrical quantity, which is a function of the light emitted from the flash unit, with the incident light value and for providing another quench signal when the electrical quantity bears a predetermined relationship to the incident light value.

9. A method of measuring the incident light at a scene from an automatic electronic flash unit having a flashtube which when triggered emits a flash of light of controllable duration and which flashtube is energized by a capacitor and includes quench means for terminating the flash of light from the flashtube after light of a desired quantity has been produced therefrom, comprising the steps of, positioning a remote incident flash light sensor at a scene to be photographed for receiving light from the flash unit incident at the scene, triggering the flash unit to initiate the emission of the flash of light and at substantially the same time enabling the sensor to commence measurement of the incident light thereon, and sensing the initial voltage of the flash unit capacitor when the flash of light is initiated, storing said initial voltage of said capacitor, sensing the decrease in voltage of the capacitor as the flash of light continues, and developing a voltage difference signal proportional to the difference in the initial voltage of the capacitor and the instantaneous voltage thereof, generating a quench signal from said light sensor when a predetermined quantity of incident light is received thereby, and storing said difference signal when said quench pulse is generated to thereby provide a stored incident light value, removing the light sensor from the scene, and again initiating a flash of light from said flash unit and controlling the quantity of light emitted thereby as a function of said stored incident light value.

10. An electronic flash control system comprising a flash unit having a flashtube for emitting a flash of light, a main capacitor for energizing the flashtube for providing the flash of light, trigger circuit means responsive to a sync signal for initiating the flash of light from the flashtube and for supplying a signal to enable a remote incident flash light sensor device which provides a quench pulse when sufficient light incident on a scene has been received thereby to the quench circuit of the flash unit for quenching the flashtube, and including means for supplying a voltage proportional to the voltage of the main capacitor external to the flash unit for enabling measurement and storage of a voltage proportional to the voltage drop of the main capacitor between the initiation and quench of flash from the flashtube and for receiving a subsequent quench pulse generated as a function of the stored voltage to terminate a subsequent flash.

11. A system as in claim 8, wherein said means for adjusting the sensitivity of said remote sensor includes means for selecting a desired photographic aperture for allowing a desired quantity of light to be preprogrammed for the system.

12. An electronic flash control system for measuring incident light at a scene and for controlling the flash light duration of an automatic electronic flash unit employing a capacitor for energizing a flashtube of the flash unit comprising, remote sensor means for measuring incident light at a scene, said remote sensor means comprising a light sensor circuit responsive to a control signal which initiates a flash of light from a flash unit for measuring the incident light and providing a quench signal for causing termination of the flash of light, and comprising means for adjusting the sensitivity thereof to light received thereby for enabling a desired photographic aperture to be selected for allowing a desired quantity of light to be preprogrammed into the system, first circuit means responsive to the control signal and the voltage of the main capacitor for storing a voltage which is a function of the energy used from the capacitor between initiation and termination of the flash of light, second circuit means responsive to the quench signal from said remote sensor means for storing said voltage as an incident light value, and said first and second circuit means being interconnected to respond to the initiation of a subsequent flash of light for measuring the voltage which is a function of the energy used between initiation and termination of the second flash of light and providing another quench signal when this voltage bears a predetermined relationship to said incident light value.

13. An electronic flash control system for enabling incident light measurements to be made at a scene to be photographed and a signal to be stored which is proportional to the desired quantity of light received at the scene for automatically controlling quench of an electronic flash unit when taking a subsequent flash picture comprising, remote sensor means for measuring incident light at a scene, said remote sensor means comprising light sensor means of adjustable sensitivity and including a circuit responsive to a control signal for measuring the incident light and providing a quench signal for causing termination of a flash of light from an electronic flash unit, the sensitivity of the light sensor means being adjustable to allow selection of a desired aperture for causing the sensor means to respond to a desired quantity of light in providing said quench signal, first circuit means for receiving a signal proportional to the energy used in firing a flashtube of a flash unit, said first circuit means including storage means for storing the initial value of said energy and providing as an output a difference signal comprising an incident light value which is a function of the energy used in production of a flash and proportional to the quantity of light incident on the remote sensor means, second circuit means responsive to the quench signal from said remote sensor means for storing said incident light value, and said first and second circuit means being adapted to respond to the initiation of a subsequent flash of light from a flash unit for again measuring the then existing initial value of said energy and providing another quench signal when a new difference signal generated by said first circuit means bears a predetermined relationship to said incident light value.

14. A system as in claim 12 wherein, the flash unit comprises an energy source in the form of a capacitor, and said first circuit means stores a voltage proportional to the starting voltage of the capacitor and provides as an output a signal proportional to the drop in voltage of the capacitor between initiation and termination of the flash of light from the flash unit.

15. A method for measuring the incident light at a scene from an automatic electronic flash unit having a flashtube which when triggered emits a flash of light of controllable duration and which flashtube is energized by a capacitor and includes quench means for terminating the flash of light from the flashtube after light of a desired quantity has been produced therefrom, comprising the steps of, positioning a remote incident flash light sensor at a scene to be photographed for receiving light from the flash unit incident at the scene, and adjusting the sensitivity of the light sensor to be responsive to a desired quantity of light representing an aperture value for a particular film speed, triggering the flash unit to initiate the emission of the flash of light and at substantially the same time enabling the sensor to commence measurement of the incident light thereon, and sensing the initial voltage of the flash unit capacitor when the flash of light is initiated, storing said initial voltage of said capacitor, sensing the decrease in voltage of the capacitor as the flash of light continues, and developing a voltage difference signal proportional to the difference in the initial voltage of the capacitor and the instantaneous voltage thereof, generating a quench signal from said light sensor when said desired quantity of incident light is received thereby, and storing said difference signal when said quench pulse is generated to thereby provide a stored incident light value, removing the light sensor from the scene, and again initiating a flash of light from said flash unit and controlling the quantity of light emitted thereby as a function of said stored incident light value.

* * * * *